US009925816B2

(12) United States Patent
Klages et al.

(10) Patent No.: US 9,925,816 B2
(45) Date of Patent: Mar. 27, 2018

(54) CARRIER SHEET FOR A PLURALITY OF INFORMATION (MEDIA) CARRIERS

(71) Applicant: PHOENIX CONTACT GMBH & CO. KG, Blomberg (DE)

(72) Inventors: Kilian Klages, Detmold (DE); Moez Bibani, Detmold (DE); Jörg Donoth, Paderborn (DE); Nicole Probach, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 15/129,116

(22) PCT Filed: Mar. 25, 2015

(86) PCT No.: PCT/EP2015/056381

§ 371 (c)(1),
(2) Date: Sep. 26, 2016

(87) PCT Pub. No.: WO2015/144756

PCT Pub. Date: Oct. 1, 2015

(65) Prior Publication Data

US 2017/0113477 A1 Apr. 27, 2017

(30) Foreign Application Priority Data

Mar. 26, 2014 (DE) ..... 10 2014 004 340

(51) Int. Cl.

| | |
|---|---|
| ***B41M 5/50*** | (2006.01) |
| ***B41J 3/407*** | (2006.01) |
| *B65C 11/02* | (2006.01) |

(52) U.S. Cl.
CPC ..... *B41M 5/506* (2013.01); *B41J 3/407* (2013.01); *B41J 3/4075* (2013.01); *B41M 5/508* (2013.01); *B65C 11/02* (2013.01)

(58) Field of Classification Search
CPC ..... B41M 5/506; B41M 5/508; B41J 3/407; B41J 3/4075; B41J 13/10; B41J 3/39; B41J 29/373; B41J 17/32; B65C 11/02; B65C 9/0006
See application file for complete search history.

(56) References Cited

U.S. PATENT DOCUMENTS

| | | | | |
|---|---|---|---|---|
| 6,569,280 | B1 * | 5/2003 | Mehta | B42D 5/027 156/247 |
| 7,309,082 | B1 | 12/2007 | Edwards | |
| 8,905,657 | B2 * | 12/2014 | Grunenberg | B41J 3/28 101/41 |
| 2004/0050854 | A1 * | 3/2004 | Presutti | B65C 9/0006 221/73 |
| 2007/0275223 | A1 | 11/2007 | Edwards | |

* cited by examiner

*Primary Examiner* — Henok Legesse
(74) *Attorney, Agent, or Firm* — David S. Safran

(57) ABSTRACT

A carrier sheet (1) for a plurality of information carriers (2). The carriers can be secured to the upper side of the carrier sheet (1) and can be marked using a marking device. The carrier sheet (1) allows simple and fast marking of information carriers (2) followed by simple handling of the information carriers (2) and carrier sheet (1) by virtue of the fact that, on the upper side of the carrier sheet (1), a plurality of fields (3) is arranged, each of which can be used to position an information carrier (2) on the upper side of the carrier sheet (1), these fields (3) being able to be separated from the rest of the carrier sheet (1).

9 Claims, 3 Drawing Sheets

CARRIER SHEET FOR A PLURALITY OF INFORMATION (MEDIA) CARRIERS

BACKGROUND OF THE INVENTION

Field of the Invention

The invention relates to a carrier sheet for a plurality of information carriers that can be fastened to the top side of the carrier sheet, which information carriers can be marked by means of a marking device, in particular a marking laser. Moreover, the invention also relates to a marking object with a corresponding carrier sheet and at least one information medium.

Description of Related Art

In industrial and commercial practice, different types of information media, which in most cases are also referred to as identifying and marking signs, are used for identifying and labeling machines, devices, clamps or cables, to which is applied information relative to the components to which the information media are assigned. To this end, the identifying and marking signs are usually provided in a marking device with a corresponding marking pattern, in general alphanumeric characters. In this case, the marking can be done in particular by means of a printer, for example a laser printer, an inkjet printer, or a thermal transfer printer, with which the respective information is imprinted on the information medium. Metal signs are frequently also used as identifying or marking signs, in which the marking can also be done by a corresponding engraving with an engraving machine.

Moreover, for several years now, marking lasers in which the surface of the information medium that is to be marked is directly exposed to a laser beam have also been used as marking devices, so that the marking is not done by printing but rather by treating the material of the information medium. Depending on the material of the information medium and depending on the wavelength of the laser, in this case, the marking can be done by staining (carbonization), foaming, engraving, or material removal. In the carrier sheet according to the invention or the marking object according to the invention, the marking of the individual information media is preferably done by means of such a marking laser, without the invention, however, being supposed to be limited thereto.

For marking the individual information media, the latter can be inserted individually into a corresponding receptacle in the marking device. This has the advantage of a very great flexibility, since information media of different sizes can be used; however, the relatively large amount of time required for the exact positioning of the information medium within the treatment region of the marking device is disadvantageous in this case. Moreover, the parameters for the marking process in general must be input manually by the user.

If a plurality of identical or similar information carriers are to be marked, in practice carrier sheets on which a plurality of information carriers are applied are often used. By using such carrier sheets, a larger number of information carriers can be marked in a shorter time; however, for this purpose, the flexibilty in relation to the use of different information carriers is reduced. The fastening of the information carriers to the top of the carrier sheet is in this case done in general by means of an adhesive layer, which is applied either to the top of the carrier sheet or to the bottom of the information carrier. In this case, the adhesive layer is designed in such a way that the information media cannot be easily peeled off again from the carrier sheet after the marking process. In this case, however, it may occur that adhesive residue will remain on the carrier sheet or on the information carrier, which can be disruptive in the case of further use.

SUMMARY OF THE INVENTION

The object of this invention is therefore to create a carrier sheet or a marking object that comprises a carrier sheet and at least one information medium, which allows a marking of information media that is as easy and fast as possible, whereby in particular, a handling of the information media and the carrier sheet after the marking process that is as easy and flexible as possible is also to be possible.

This object is achieved in the case of the above-described carrier sheet in such a way that the carrier sheet has a plurality of fields, which in each case are used in the positioning of an information carrier on the top of the carrier sheet, and the individual fields can be separated from the rest of the carrier sheet. Owing to the formation of the fields, first a simple positioning of the information media that are to be marked on the individual fields and thus on the carrier sheet is possible. As a result of the individual fields being able to be separated from the rest of the carrier sheet, individual information media can be separated from the carrier sheet after the marking process together with the respective field to which they are connected, so that a recess in the carrier sheet remains at the original location of the field.

The separation of a field together with the information medium fastened thereto has the advantage, in contrast to peeling off only the information medium from the carrier sheet, that no adhesive residue can remain adhering to the carrier sheet, which can result in contamination and under certain circumstances in malfunctions during the marking process. In addition, it is easily possible first to mark only some of the information media or else only an individual information medium, to separate the marked information media together with the respective fields from the carrier sheet, and then to lay aside the carrier sheet, without the danger that the carrier sheet will be bonded to other carrier sheets, since there is adhesive residue on the top of the carrier sheet.

The possibility also exists that the information media together with the respective fields will be separated first to store already marked information media with the fields to which they are bonded, for example also to stack them, and to peel off the information media from the respective fields only at a later time. Also, here, adhesion of the information media to other objects or other information media cannot occur, since the adhesive layer that is applied on the bottom of an information medium is covered by the field that is separated from the carrier sheet.

In order to facilitate the separation of the fields from the carrier sheet, in each case a perforation can be provided between the individual fields and the rest of the carrier sheet surrounding the individual field, so that individual fields can be easily separated from the rest of the carrier sheet. Another configuration calls for a field to be connected to the rest of the carrier sheet only via multiple arms. It is also possible that the individual fields in each case are connected via an at least partially circumferential edge to the rest of the carrier sheet, whereby the circumferential edge has a smaller thickness than the carrier sheet, so that the thus weakened edge represents a "scoring point" when a field is separated from the carrier sheet.

In this case, the separation can be done in such a way that one of the marked information media, together with the field to which it is bonded, is squeezed out downward from the carrier sheet, viewed from the top of the carrier sheet, so that the field is cut out from the rest of the carrier sheet at the scoring points, such as, for example, the perforation or the thin edge. In this way, the other information media also are not damaged in this process.

The information media can be self-adhering when being applied onto a field or preferably can be bonded by means of an adhesive layer to a field of the carrier sheet. An advantageous configuration of the carrier sheet according to the invention calls for the adhesive layer, which is applied to the fields, to be designed in such a way that after an information medium is removed, the respective adhesive layer remains on the top of the field. As a result, a marked information medium can be directly further processed. In addition, the adhesive layer can be covered with a film that can be peeled off or another material before an information medium is applied, so that the adhesive layer is protected and is not rendered ineffective by possible contaminants or deterioration of its adhesive properties.

In addition, the carrier sheet according to the invention has the advantage that it can be very easily produced, whereby the individual fields can be matched to the information media that are to be marked in each case. As a result, carrier sheets correspondingly matched to different information media can be made available. Moreover, in principle, it is also possible that fields with different dimensions are arranged on a carrier sheet, so that different information media can be applied on a carrier sheet.

The marking process of individual information media can be simplified for the user according to a preferred configuration of the invention in such a way that in each case, an identifying field is provided on the top in an edge area of the carrier sheet, in which field information is applied via the information media that are to be marked. The information applied in the identifying field is in particular such information that is required by the marking device for marking the information media. In this connection, for example, this can be the indication of the material of the information medium that is applied as an article number, for example, as a barcode, in the identifying field. Such a barcode, applied to the carrier sheet at a preset position, can then be automatically read-in before the marking process by the marking device, so that the marking device can then determine the irradiation intensity and the irradiation time, for example, based on the acquired article number and the material of the information media that can be determined therefrom, in the case where a marking laser is established as a marking device. A manual setting or input of marking parameters can thus be at least partially omitted. Of course, the information that is applied in the identifying field can also be produced by means other than a barcode, for example by means of an RFID chip or a magnetic strip, which both also make possible contact-free reading of information by the marking device.

According to another advantageous configuration of the invention, in each case another identifying field is provided on the top in an edge area of the carrier sheet, in which field the information as to which information media of the carrier sheet are already marked or which information media are still not marked can be applied. The information, which can be indicated, for example, in the form of a barcode, is in this case preferably applied by the marking device, with which the information media are also marked, so that the carrier sheet—at least in the area of the additional identifying field—is made of a material that can be marked with the marking device, in particular with a marking laser.

This preferred configuration then also allows a suitable marking device to correctly mark carrier sheets or the information media applied thereon, when individual information media are already marked. In this connection, a double marking of individual information media, which otherwise could no longer be used under certain circumstances, can be avoided. In addition, the possibility is thus provided, in the case of a carrier sheet, first to mark only individual information media, then to remove the carrier sheet from the marking device and, at a later time, after the already marked information media optionally have already been removed from the carrier sheet, to mark additional information media also applied on the carrier sheet.

Another advantageous configuration of the invention, by which the marking process can be further reduced, calls for two holes to be arranged in an edge area of the carrier sheet, which holes are used for correct positioning of the carrier sheet in the treatment region of the marking device. In this case, the two holes preferably have different dimensions, so that only a certain arrangement of the carrier sheet in the treatment region of a marking device is possible, when pins or receptacles corresponding to the holes are made in the treatment region.

According to a preferred modified embodiment of the marking object according to the invention in accordance with claim 7, individual adhesive layers for the information media are provided on the top of the carrier sheet in the area of the individual fields. As an alternative to this, the adhesive layer used for fastening an information medium to the carrier sheet can also be provided on the information medium. In the first variant embodiment, the adhesive layer is preferably designed in such a way that after the information medium is removed from the top of the separated field, the adhesive layer remains on the top of the carrier sheet, i.e., the information medium can be detached from the separated field without the residue of the adhesive layer remaining on the information medium. In the second variant, in which the information medium is designed to be self-adhesive, the adhesive layer remains after the information medium is detached from the field, preferably on the information medium.

In particular, there are now a number of possibilities of configuring and further developing the carrier sheet according to the invention or the marking object according to the invention as will be apparent from the following description of two embodiments in connection with the accompanying drawings.

DETAILED DESCRIPTION OF THE INVENTION

Figure 3:
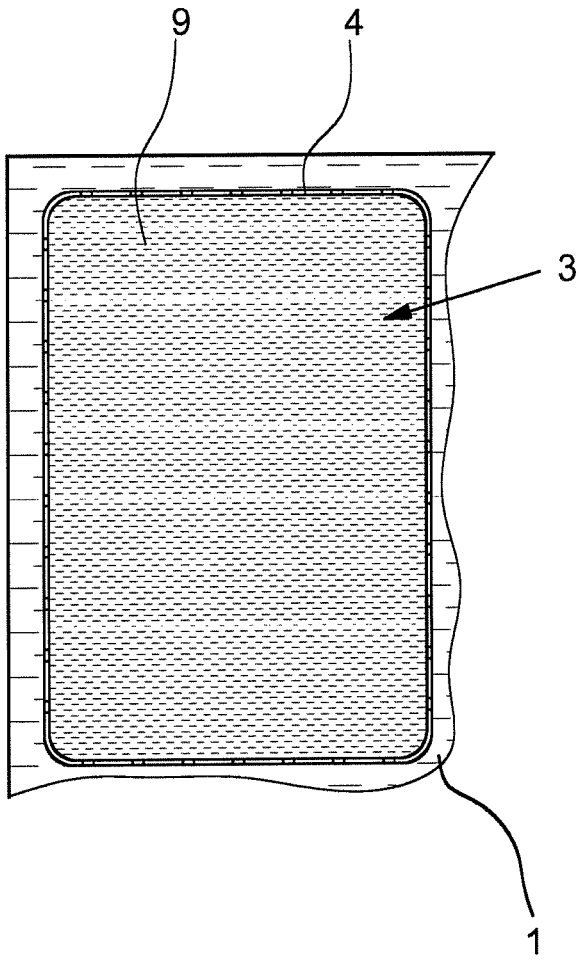
FIG. 3 is an enlarged view of an individual field of another carrier sheet.

The figures show an embodiment of a marking object that is comprised, in each case, of a carrier sheet 1 and multiple information carriers 2 fastened to the top of the carrier sheet 1. The information carriers 2 can be, for example, metal signs or plastic signs, which, for labeling devices or machines, can be fastened to the latter. Depicted in each case is the view of the top of the carrier sheet 1, whereby FIG. 3 shows an enlarged view of an individual field of a carrier sheet 1 according to the invention. Of course, in this case, the shape and size of the information carrier 2 is not limited to the depicted embodiments.

Figure 1:
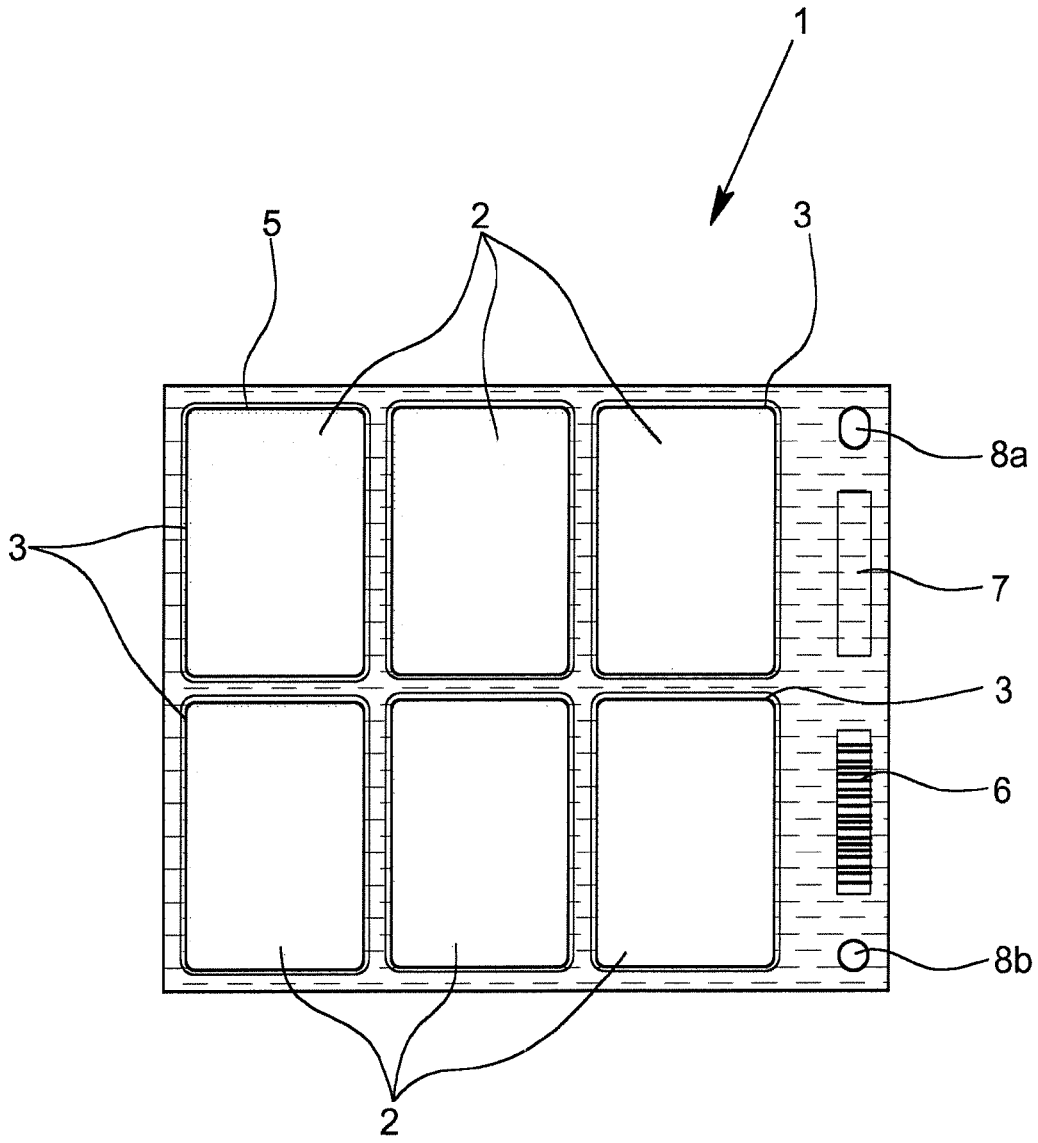
FIG. 1 is a top plan view of a first embodiment of a marking object with multiple information media bonded to a carrier sheet, from the top.

As can be seen from FIG. 1, the carrier sheet 1 has a plurality of—in this case, six—fields 3, which in each case are used in the positioning of an information carrier 2 on the top of the carrier sheet 1. If a carrier sheet 1 or a marking object is introduced with the orientation according to FIG. 1 in the treatment region of a marking device, the individual information carriers 2 bonded to the fields 3 can be provided with a marking on their tops.

Figure 2:
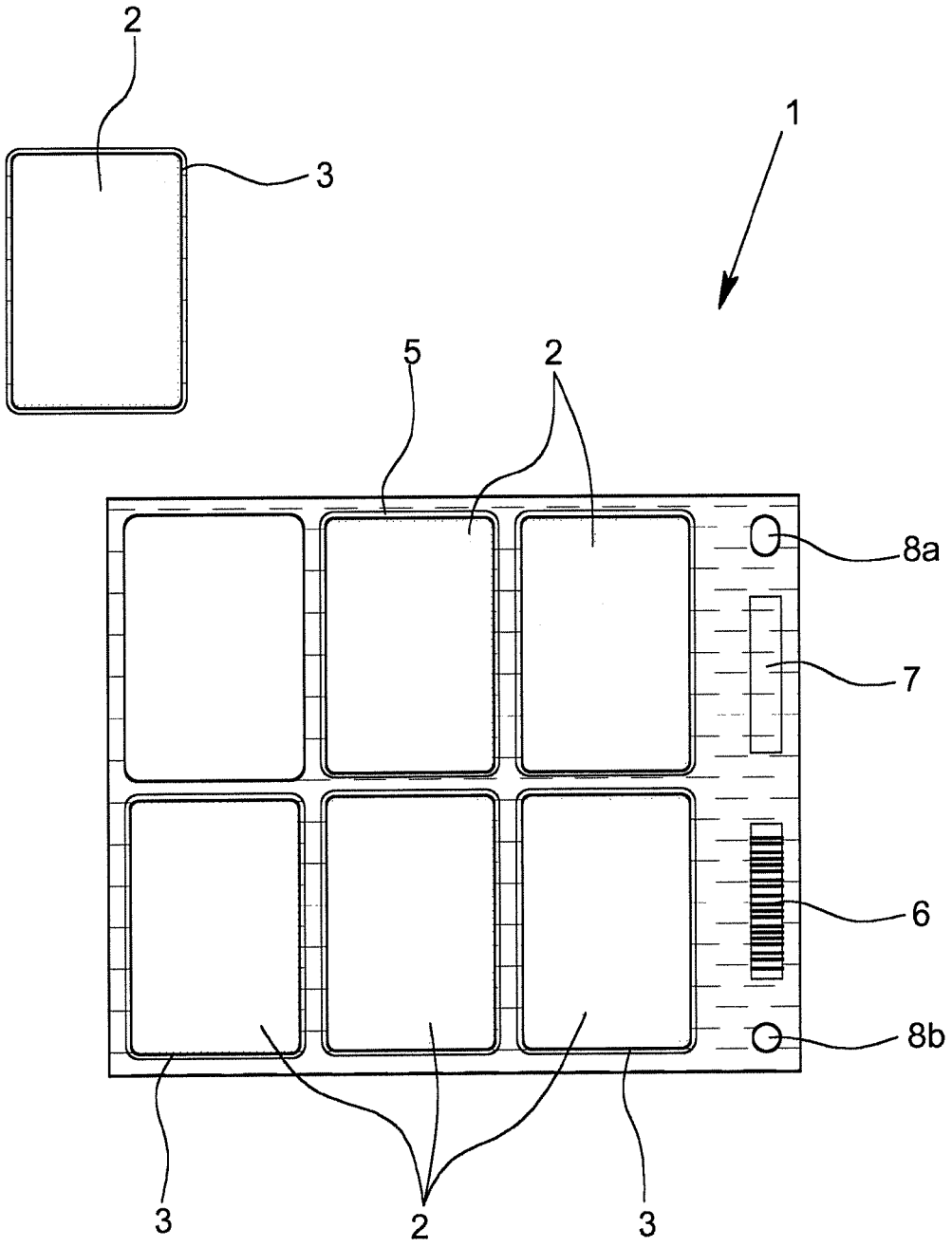
FIG. 2 shows the marking object according to FIG. 1, with an information medium cutout.

FIG. 2 shows a carrier sheet 1, from which a—next to it, depicted separately—field 3 with a bonded information carrier 2 has been cut out. So that a field 3 with the information carrier 2 that is bonded thereto can be easily separated from the residual carrier sheet 1, for example, a perforation 4 can be provided, i.e., the contour of the field 3 can have multiple holes, as FIG. 3 shows. As an alternative, a field 3 can also have a circumferential edge 5, whose thickness is reduced, as is indicated in FIG. 2. Both the perforation 4 and the edge 5 with the reduced thickness, in each case, form scoring points, at which the field 3 together with the information carrier 2 can be easily separated from the carrier sheet 1.

In the embodiment shown in FIGS. 1 and 2, in an edge area of the carrier sheet 1 in which no fields 3 are arranged, an identifying field 6 is provided, in which field a piece of information about the information carrier 2 that is to be marked, in particular its material is applied in the form of a barcode. In addition, in the same edge area of the carrier sheet 1, a second identifying field 7 is also provided, in which field information as to which information carriers 2 are already marked can be applied by the marking device according to a marking process. Also, the information applied by the marking device in the second identifying field 7 via the already marked information carrier 2 is in this case preferably shown in the form of a barcode. So that this information can be applied by the marking device, with which the information carriers 2 are also marked, the carrier sheet 1—at least in the area of the additional identifying field 7—is formed of a material that can be readily marked with the marking device, in particular with a marking laser.

In edge area of the carrier sheet 1, moreover, two holes 8*a*, 8*b* are arranged, which are used so that the carrier sheet 1 can be positioned quickly and simultaneously exactly in the treatment region of the marking device. In this case, the two holes 8*a*, 8*b* are arranged in the area of two corners of the carrier sheet 1. If pins corresponding to the holes 8*a* and 8*b* are made in the treatment region of a marking device, a carrier sheet 1 can be placed with the holes 8*a*, 8*b* on the pins, by which in a simple way, an exact positioning of the carrier sheet 1 in the treatment region can be achieved. In this case, in order to ensure a correct orientation of the carrier sheet 1, the holes 8*a*, 8*b* have different dimensions, whereby in this case, the hole 8*a* is designed as a slot, and the hole 8*b* is designed as a round hole. In this connection, the carrier sheet 1 is prevented from slipping with the top downward while being inserted into the treatment region.

To fasten the individual information carrier 2 on the carrier sheet 1, in the depicted embodiment, in each case, an adhesive layer 9 is applied on the top of the individual fields 3, which layer is designed in such a way that after an information carrier 2 is peeled off from the field 3 that has been cut out, the adhesive layer 9 remains on the field 3, i.e., no residue of the adhesive layer 9 continues to adhere to the information carrier 2. In principle, however, the possibility also exists of designing the individual information carriers 2 to be self-adhesive, so that the individual adhesive layers would then be arranged on the bottoms of the information media 2.

What is claimed is:

1. Carrier sheet wherein the carrier sheet comprises:

a plurality of fields, each of which is able to receive an information carrier thereon on top of the carrier sheet, whereby each of the plurality of fields together with the information carrier thereon is connected to the rest of the carrier sheet in a separable manner that forms a recess in the carrier sheet when the field and the information carrier thereon are separated from the carrier sheet.

2. Carrier sheet according to claim 1, wherein each of the individual fields is connected to the carrier sheet via perforations.

3. Carrier sheet according to claim 1, wherein each of the individual fields is connected to the carrier sheet via an at least partially circumferential edge, the circumferential edge having a smaller thickness than the carrier sheet.

4. Carrier sheet according to claim 1, wherein each identifying field is provided on the top of the carrier sheet in an edge area of the carrier sheet, which field information is applied via the information carriers to be marked.

5. Carrier sheet according to claim 1, wherein each identifying field is provided on the top of the carrier sheet in an edge area of the carrier sheet, each identifying field having information as to which information media have already been marked or which information carriers have not yet marked.

6. Carrier sheet according to claim 1, wherein two holes are arranged in an edge area of the carrier sheet in an area of two opposite corners.

7. Marking object, comprising:

multiple information carriers, a carrier sheet having a top surface on which the multiple information carriers are fastenable, wherein the information carriers are markable by means of a marking device, wherein the carrier sheet comprises multiple fields, each of which is receives an information carrier thereon, wherein each of the multiple fields is connected to the rest of the carrier sheet in a separable manner, and wherein at least one of the multiple information carriers is fastened by means of an adhesive layer to at least one of the multiple fields of the carrier sheet, the adhesive being removed from the carrier sheet upon separation of said at least one of the multiple fields from the carrier sheet together with the one of the information carriers thereon.

8. Marking object according to claim 7, wherein, an adhesive layer for an information carrier is applied on the top side of each of the individual fields.

9. Marking object according to claim 8, wherein the adhesive layer has properties causing enabling the adhesive to remain on the field after an information carrier is removed from the side of the separated field.

* * * * *